US006637221B1

(12) United States Patent
Jenkins et al.

(10) Patent No.: US 6,637,221 B1
(45) Date of Patent: Oct. 28, 2003

(54) DUAL SETPOINT CONTROL FOR AN ABSORPTION CHILLER

(75) Inventors: Neil D. Jenkins, Collegeville, PA (US); Richard A. Kolk, Glastonbury, CT (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/160,328

(22) Filed: May 31, 2002

(51) Int. Cl.[7] ..... F25B 15/00

(52) U.S. Cl. ..... 62/148; 62/141; 62/476; 62/101; 62/108; 62/109; 62/107

(58) Field of Search ..... 62/148, 141, 476, 62/101, 108, 109, 107

(56) References Cited

U.S. PATENT DOCUMENTS 4,487,026 A * 12/1984 Alfano ..... 62/101
5,275,010 A * 1/1994 Hisajima et al. ..... 62/148
5,289,868 A * 3/1994 Koseki et al. ..... 165/14
5,477,696 A * 12/1995 Takahata et al. ..... 62/148
5,586,447 A * 12/1996 Sibik et al. ..... 62/141
5,623,426 A * 4/1997 Ozawa et al. ..... 364/557
5,724,823 A * 3/1998 Martini et al. ..... 62/148
5,816,070 A * 10/1998 Meckler ..... 62/476
6,038,882 A * 3/2000 Kuroda et al. ..... 62/476
6,260,364 B1 * 7/2001 Moon et al. ..... 62/141

* cited by examiner

*Primary Examiner*—William C. Doerrler
*Assistant Examiner*—Mark Shulman
(74) *Attorney, Agent, or Firm*—Wall Marjama & Bilinski LLP

(57) ABSTRACT

A method of controlling the capacity of an absorption chiller by regulating the heat input to a generator in response to a selected one of two system variables. The first variable involves the measured chilled water temperature leaving the system evaporator and the second involves the calculated solution concentration that is being returned to the absorber. Data relating to each variable is sent to a selector where it is processed so that the data can be used to control the heat input to the generator. The temperature data is used to control the heat input during normal chiller operation, however, the selector changes over control to the concentrate related data when the solution concentration level approaches the solution crystallization limit.

9 Claims, 1 Drawing Sheet

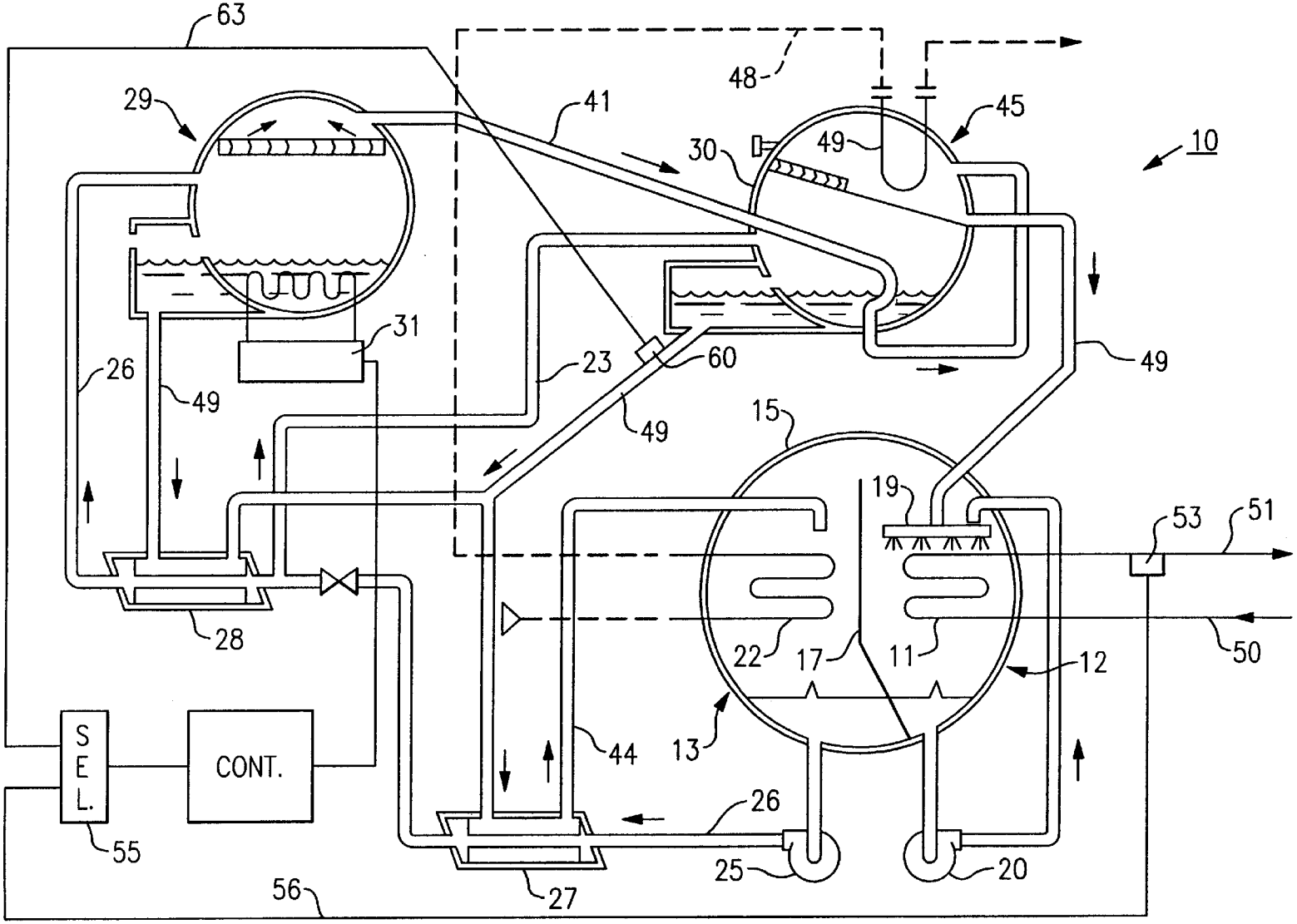
10
45
49
48
30
41
60
23
31
29
63
26
28
49
15
19
11
17
22
12
13
51
53
50
20
25
26
44
27
56
CONT.
55
S
E
L.

DUAL SETPOINT CONTROL FOR AN ABSORPTION CHILLER

FIELD OF THE INVENTION

This invention relates to an absorption chiller and, in particular to a method of controlling the capacity of an absorption chiller using two control variables to enable the chiller to operate close to the crystallization limit of the solution.

BACKGROUND OF THE INVENTION

Heretofore, the temperature of the chilled water leaving the evaporator of an absorption machine was used as the sole variable to control the capacity of the machine. In the event the concentration of the solution leaving the lowest stage generator of the machine moved to one percent of the calculated crystallization concentration, the burner valve to the upper stage generator was prevented from opening any further. If the concentration continued to increase to within 0.6 percent of the crystallization limit, the heat input to the generator was reduced to about 67 percent of its previous setting and the burner was held at the 67 percent setting for a given period of time, usually about five minutes. This allowed the chilled water temperature to rise and the solution concentration leaving the lowest stage generator of the machine to be reduced sufficiently so that normal control over the burner could be once again resumed.

Although, this capacity control method works well under most operating conditions, there are times where the load demands on the chiller are such that the burner must be cycled at relatively short intervals to prevent crystallization of the solution. Accordingly, the chilled water leaving temperature changes repeatedly during this period. This repeated cycling of the burner may adversely effect performance and under certain conditions can waste energy.

SUMMARY OF THE INVENTION

It is therefore a primary object of this invention to improve absorption chillers.

It is a further object of this invention to more smoothly control the capacity of an absorption chiller as the solution concentration approaches the solution crystallization limit.

A still further object of this invention is to maintain the chilled water leaving temperature relatively constant during periods where the solution concentration of an absorption chiller approaches the solution crystallization limit.

Another object of the present invention is to use more than one variable to control the burner of an absorption chiller to permit the chiller to operate efficiently when the solution concentration is close to the crystallization limit.

These and other objects of the invention are attained by a capacity control procedure that includes measuring the chilled water temperature leaving the evaporator of an absorption chiller and controlling the burner of the chiller in response thereto until such time as the solution concentration being returned to the absorber approaches the solution crystallization limit. At this time control of the burner is changed over to respond to the concentration level of the solution to maintain the concentration at a steady desired setpoint below the crystallization limit. When the load condition changes to a point where the solution concentration is a given percentage away from the solution crystallization limit control of the burner is returned to the chilled water leaving temperature.

BRIEF DESCRIPTION OF THE DRAWING

For a better understanding of these and other objects of the invention reference will be made to the following description of the invention which is to be read in association with the accompanying drawing which is a schematic representation of a two stage absorption chiller embodying the teachings of the present invention.

DETAILED DESCRIPTION OF THE INVENTION

Turning initially to the drawing, there is illustrated an absorption chiller, generally referenced 10, that embodies the teachings of the present invention. The unit depicted in the drawing is a two stage machine containing a first stage high temperature generator and second stage low temperature generator. Although, the invention will be explained with particular reference to a two stage absorption chiller, it should be clear from the description below that the invention can be practiced in conjunction with either a multiple stage machine or a single stage machine.

The present chiller is arranged to chill water that is passed through the tubes of a chilled water heat exchanger 11 that is located in the machines evaporator section 12. The evaporator 12 and the absorber 13 are both mounted together in a single shell 15 in a side by side alignment. The absorber section is separated from the evaporator section by a wall that extends across the length of the shell 17.

The present chiller utilizes water as a refrigerant and lithium bromide as an absorbent. However, any other suitable combination of absorbent and refrigerant may be used in the practice of the present invention. As is normal in this type of system, a high vacuum pressure is maintained within the shell 15. The absorber is partially filled with a lithium bromide, and absorbs water vapor that is generated in the evaporator to form an absorptive solution. As will be explained in greater detail below, liquid refrigerant developed in the machine is delivered into a refrigerant spray header 19 located within the evaporator and is sprayed over the tubes of the chilled water heat exchanger whereby the chilled water gives up heat to the refrigerant as it flows over the heat exchanger.

A portion of the refrigerant in the evaporator is flash cooled at the low absolute shell pressure and passes over the wall 17 into the absorber section of the shell where it is absorbed by the lithium bromide. Liquid refrigerant that is collected in the sump of the evaporator is drawn off by the refrigerant pump 20 and recirculated through the refrigerant spray header 19. The heat that is developed within the absorber is carried off by cooling water that is passed through the tubes of the absorber heat exchanger 22. Although not shown, a cooling tower is typically placed in the cooling water loop wherein the heat carried off by the cooling water is rejected into the surrounding ambient.

The term weak solution will be used herein to define a solution that has a heavy concentration of refrigerant. The term strong solution on the other hand will be used herein to identify a solution wherein the concentration of refrigerant is relatively low. For a two stage machine as described herein, the solution concentration of lithium bromide in the solution is generally maintained within a range of between 58 and 63 percent depending on the machine load conditions. Operating the machine at concentrations above 63 percent will cause the lithium bromide to crystallize.

Weak solution developed in the absorber, which is rich in refrigerant, is drawn from the absorber by a solution pump 25. The solution is passed by means of a solution delivery line 26 in series through a first low temperature solution heat exchanger 27 and a second high temperature heat exchanger 28 prior to being delivered into the chillers first stage high temperature generator 29. A portion of weak solution leaving the low temperature heat exchanger is diverted by a solution shunt line 23 to a second stage low temperature generator 30. The weak solution moving through the two heat exchangers is brought into a heat transfer relationship with higher temperature strong solution being carried back from the generators to the absorber via the solution return line 32 thereby raising the temperature of the weak solution while it is in transit.

After passing through the high temperature heat exchanger, the weak solution enters the systems upper stage high temperature generator 29. The high temperature generator is equipped with a heater or burner 31 that is fired by any one of many well known fuels to further raise the temperature of the solution in the generator to a level where a portion of the refrigerant is taken out of solution in the form of a vapor. The refrigerant vapor produced in the high temperature generator is passed through the low temperature generator 30 via vapor line 41 prior to being delivered into the system condenser 45.

The second stage low temperature generator 30 is housed in a single shell 43 with the system condenser 45. As the refrigerant from the high temperature generator passes through the low temperature generator it gives up additional heat to the solution in the generator to help drive the generator. At the same time a portion of the refrigerant in transit is condensed. The weak solution that has been diverted to the second stage generator is heated to a level where additional refrigerant is released from the solution in the form of a vapor. The strong solution is then returned to the absorber along with that from the first stage generator via return line 44. The vapor produced in the second stage generator is passed into the system condenser 45 where it is added to the refrigerant from the first stage generator. Cooling water from the absorber is passed by cooling water line 48 through the condenser heat exchanger 49 prior to returning to the cooling tower.

Liquid refrigerant produced in the system condenser 45 is gravity feed through return line 49 from the condenser sump to the spray header of the evaporator and, as explained above, passed over the tubes of the chilled water heat exchanger to chill the water as it is passed through the evaporator tubes thereby completing the absorption cycle.

The chilled water lines servicing the evaporator heat exchanger includes a chilled water inlet line 50 and a chilled water outlet line 51. A temperature sensor 53 is placed in the outlet line 51. The sensor is adapted to detect the leaving temperature of the chilled water and send a data signal indicative of the sensed temperature to a selector 55 via transmission line 56.

Similarly, the temperature of the strong solution leaving the second stage generator is detected by a sensor 60 and the temperature data is forwarded to the selector via transmission line 61 where it is processed along with inferred generator pressure to provide calculated solution concentration data.

In the selector, the measured chilled water temperature is compared to a predetermined desired temperature setpoint and an error signal based upon the difference between the two values is applied to a selection routine. Similarly, the calculated solution concentrate is compared to a predetermined desired concentration setpoint value and an error signal based upon the difference between the two values is also applied to the selection routine. In the selection routine a gain or amplification factor is applied to each error signal. The value of each gain is dependent upon the solution concentration leaving the second or low stage generator. As the solution concentration leaving the generator approaches the solution crystallization limit, the gain of the concentration error signal increases from zero to one while the gain associated with the temperature error signal moves from one to zero.

Correspondingly, as the solution concentration moves a given percentage away from the crystallization limit, the temperature gain return to a one and the concentration gain goes back to zero and the control of the burner is returned to the temperature error input.

Normally, when the solution concentration is not close to the crystallization limit, the gain of the temperature error signal is at one and the selector routine passes the temperature data on to the system controller 70 which is programmed to regulate the burner in response thereto so as to maintain the chilled water temperature at a desired setpoint. In the event the solution concentration approaches the solution crystallization limit and the gain of the concentration error signal increases to one the selector routine changes the output of the selector and the concentration data is used to control the burner so as to maintain the solution concentration at the concentration setpoint. When the solution concentration once again moves far enough away from the crystallization limit the gain of the concentration error will decrease to zero and the gain of the temperature error signal will increase to one whereupon normal machine operations will be resumed.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A method of controlling the capacity of an absorption chiller that includes the steps of:

providing a first variable by measuring the chilled water temperature leaving the evaporator of the chiller and sending the temperature data to a selector, providing a second variable by calculating the solution concentration being returned to the absorbent of the chiller, and sending the concentration data to said selector, selecting one of the variables based on the solution crystallization level and forwarding only the selected variable data to a controller for regulating the heat input to a system generator to maintain the selected variable at a desired setpoint.

2. The method of claim 1 of normally selecting the temperature variable when the solution concentration is a given percentage below the solution crystallization limit so that the heat input to the generator is regulated to maintain the chilled water leaving temperature at a given temperature setpoint.

3. The method of claim 2 of changing the variable selection from the temperature variable to the concentration variable when the solution concentration moves above said given percentage so that the heat input to the generator is regulated to maintain the solution concentration at a desired concentration setpoint.

4. The method of claim 3 where the chiller has multiple stages and the second variable is based on calculations relating to the solution leaving the lowest stage generator.

5. The method of claim 4 that includes the further step of providing heat to a burner that is associated with an upper stage generator.

6. The method of claim 3 that includes the further step of returning control of the heat input to the generator back to the first temperature variable in the event the solution concentration moves below said given percentage.

7. The method of claim 1 that includes the further steps determining the difference between measured chilled water temperature and a given setpoint temperature and generating a temperature error signal in response thereto and determining the difference between the calculated solution concentration and said concentration setpoint ane generating a concentration error signal in response thereto.

8. The method of claim 7 that includes the further steps of applying a gain to each error signal such that gain associated with the temperature error signal decreases from one to zero and the gain associated with the concentration error signal increases from zero to one as the solution concentration approaches the concentration setpoint.

9. The method of claim 8 that includes the further step whereby the gain associated with the concentration error signal is decreased to zero when and the gain associated with the temperature increases to one when the solution concentration moves a given percentage below the concentration setpoint.

* * * * *